US012385367B2

(12) United States Patent
Cruz et al.

(10) Patent No.: US 12,385,367 B2
(45) Date of Patent: Aug. 12, 2025

(54) MONITORING WELL CONDITIONS ACROSS LINER HANGER PACKERS

(71) Applicant: Saudi Arabian Oil Company, Dhahran (SA)

(72) Inventors: Raul Alfredo Garrido Cruz, Dhahran (SA); Mario Augusto Rivas Martinez, Dhahran (SA); Kenechukwu O. Ufondu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 110 days.

(21) Appl. No.: 18/326,357

(22) Filed: May 31, 2023

(65) Prior Publication Data

US 2024/0401439 A1 Dec. 5, 2024

(51) Int. Cl.

| | |
|---|---|
| ***E21B 43/10*** | (2006.01) |
| ***E21B 47/06*** | (2012.01) |
| ***E21B 47/07*** | (2012.01) |
| ***E21B 47/10*** | (2012.01) |
| ***E21B 47/12*** | (2012.01) |

(52) U.S. Cl.

CPC ..... *E21B 43/10* (2013.01); *E21B 47/06* (2013.01); *E21B 47/07* (2020.05); *E21B 47/10* (2013.01); *E21B 47/12* (2013.01)

(58) Field of Classification Search

CPC ..... E21B 43/10; E21B 47/06; E21B 47/07; E21B 47/12

See application file for complete search history.

(56) References Cited

U.S. PATENT DOCUMENTS

| | | | | |
|---|---|---|---|---|
| 2,211,206 | A * | 8/1940 | Howard | E21B 43/10 166/158 |
| 4,116,044 | A * | 9/1978 | Garrett | E21B 33/035 73/40.5 R |
| 5,366,017 | A * | 11/1994 | Voss, Jr. | E21B 33/0355 166/88.4 |
| 10,612,366 | B2 * | 4/2020 | Gilleland | E21B 47/092 |
| 11,421,492 | B2 | 8/2022 | Rivas Martinez et al. | |
| 2016/0003027 | A1 * | 1/2016 | Thompson | E21B 33/04 73/152.57 |
| 2018/0179881 | A1 * | 6/2018 | Thompson | G01V 11/002 |
| 2018/0179886 | A1 * | 6/2018 | Espe | E21B 47/16 |
| 2024/0068319 | A1 * | 2/2024 | Beaver | E21B 33/03 |

* cited by examiner

*Primary Examiner* — Blake Michener
(74) *Attorney, Agent, or Firm* — Fish & Richardson P.C.

(57) ABSTRACT

A well tool assembly to monitor conditions across a liner hanger packer includes a liner hanger to support a well liner. A liner packer, which includes a seal element, two sensor sub-assemblies and a controller, is coupled to the liner hanger. The seal element is on an outer surface of the liner packer and can fluidically seal the outer surface of the liner packer to the inner surface of the tubular. The first sensor sub-assembly and the second sensor sub-assembly are attached to the outer surface of the liner packer on either side of the seal element. Each sensor sub-assembly can, respectively, sense well properties on the side of the seal element on which the sub-assembly is attached. The controller is operatively coupled to the two sensor sub-assemblies, and can receive sensed well properties from the two sensor sub-assemblies, and transmit the received sensed well properties to a receiver.

15 Claims, 4 Drawing Sheets

MONITORING WELL CONDITIONS ACROSS LINER HANGER PACKERS

TECHNICAL FIELD

This disclosure relates to operations involving a well, for example, one through which hydrocarbons can be produced, including, for example, well construction operations and well production operations.

BACKGROUND

Hydrocarbon wells have casing strings, or liners, installed prior to penetrating a subterranean zone to a subsurface reservoir and beginning production of hydrocarbons (petroleum, natural gas, combinations of them). Such casing strings provide weight hanging capability and pressure zonal isolation. In some instances, more than one casing string can be run. In such instances, the first casing string, installed at the top of the well, has the largest diameter. Thereafter, a subsequent casing string is placed into the well by passing it through the already installed first casing string. A liner (or liner string) is installed within a casing string to flow fluids (e.g., drilling mud, casing cement, or other fluids) from a surface of the well to downhole locations in the well. A liner hanger is a well tool that is used to install (i.e., hang) the liner from the downhole end of the casing string.

SUMMARY

This specification describes technologies relating to monitoring well conditions across liner hanger packers.

Certain aspects of the subject matter described here can be implemented as a well tool assembly. The assembly includes a liner hanger that can support a liner within a well. The liner hanger can be supported by a tubular installed within the well. A liner packer is coupled to the liner hanger. The liner packer can fluidically seal an outer surface of the liner hanger to an inner surface of the tubular. The liner packer includes a seal element, two sensor sub-assemblies and a controller. The seal element is on an outer surface of the liner packer and can fluidically seal the outer surface of the liner packer to the inner surface of the tubular. The first sensor sub-assembly is attached to the outer surface of the liner packer on a first portion of the liner packer between the seal element and a first end of the liner packer. The first sensor sub-assembly can sense well properties in a first space between the outer space of the liner packer and the inner surface of the tubular. The second sensor sub-assembly is attached to the outer surface of the liner packer on a second portion of the liner packer between the seal element and a second end of the liner packer. The second end is opposite the first end. The second sensor sub-assembly can sense well properties in a second space between the outer surface of the liner packer and the inner surface of the tubular. The controller is operatively coupled to the two sensor sub-assemblies. The controller includes one or more processors and a computer-readable medium storing instructions executable by the one or more processors to perform operations that include receiving sensed well properties from the two sensor sub-assemblies, and transmitting the received sensed well properties to a receiver.

An aspect combinable with any other aspect includes the following features. When the assembly is installed within the well, the first portion is uphole of the liner packer, and the second portion is downhole of the liner packer.

An aspect combinable with any other aspect includes the following features. The seal element can fluidically isolate the first portion from the second portion.

An aspect combinable with any other aspect includes the following features. Each of the first sensor sub-assembly and the second sensor sub-assembly, respectively, includes a pressure sensor configured to sense a pressure in the first portion and the second portion, respectively, and a temperature sensor configured to sense a temperature in the first portion and the second portion, respectively.

An aspect combinable with any other aspect includes the following features. The controller is attached to the first portion of the liner packer.

An aspect combinable with any other aspect includes the following features. The second sensor sub-assembly can transmit the sensed well properties to the controller across the seal element.

An aspect combinable with any other aspect includes the following features. The receiver can wirelessly receive the sensed well properties from the two sensor sub-assemblies.

An aspect combinable with any other aspect includes the following features. A liner tieback receptacle is positioned between the liner hanger and the liner packer. The liner tieback receptacle can receive an end of the liner to form a fluidically sealed conduit from the liner through the liner hanger.

Certain aspects of the subject matter described here can be implemented as a method. A well tool assembly is formed by attaching a seal element to an outer surface of a liner packer. The seal element can fluidically seal the outer surface of the liner packer to an inner surface of a tubular in which the liner packer is configured to be installed. A first sensor sub-assembly is attached to the outer surface of the liner packer on a first portion of the liner packer between the seal element and a first end of the liner packer. A second sensor sub-assembly is attached to the outer surface of the liner packer on a second portion of the liner packer between the seal element and a second end of the liner packer, the second end opposite the first end. A controller is attached on the outer surface of the liner packer on the first portion. The controller can receive sensed well properties from the first sensor sub-assembly and the second sensor sub-assembly. A liner hanger is coupled to the liner packer. The liner hanger can support a liner within the well. The liner hanger is supported by the tubular. The well tool assembly is run into and set at a downhole location in a well. The well properties sensed by the first sensor sub-assembly and the second sensor sub-assembly are periodically received at a surface of the well from the controller.

An aspect combinable with any other aspect includes the following features. After running the well tool assembly into and setting the well tool assembly at the downhole location in the well, the first portion is uphole of the liner packer, and the second portion is downhole of the liner packer. The first portion is fluidically isolated from the second portion.

An aspect combinable with any other aspect includes the following features. Each of the first sensor sub-assembly and the second sensor sub-assembly, respectively, includes a pressure sensor configured to sense a pressure in the first portion and the second portion and a temperature sensor configured to sense a temperature in the first portion and the second portion. Each pressure sensor senses the pressure in the first portion and the second portion, respectively. Each temperature sensor senses the temperature in the first portion and the second portion, respectively.

An aspect combinable with any other aspect includes the following features. Based on the well properties received at the surface, a change in the well properties sensed by the second sensor sub-assembly are determined. In response to the determining, corrective well operations are performed.

An aspect combinable with any other aspect includes the following features. The change in the well properties includes a change in the pressure sensed by a pressure sensor. The pressure sensor is installed in an annulus between the outer surface of the liner packer and the inner surface of the tubular.

An aspect combinable with any other aspect includes the following features. The change in the well properties includes a change in the temperature sensed by a temperature sensor. The temperature sensor is installed in an annulus between the outer surface of the liner packer and the inner surface of the tubular.

An aspect combinable with any other aspect includes the following features. The corrective well operations include ceasing well operations until the corrective well operations have been completed.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
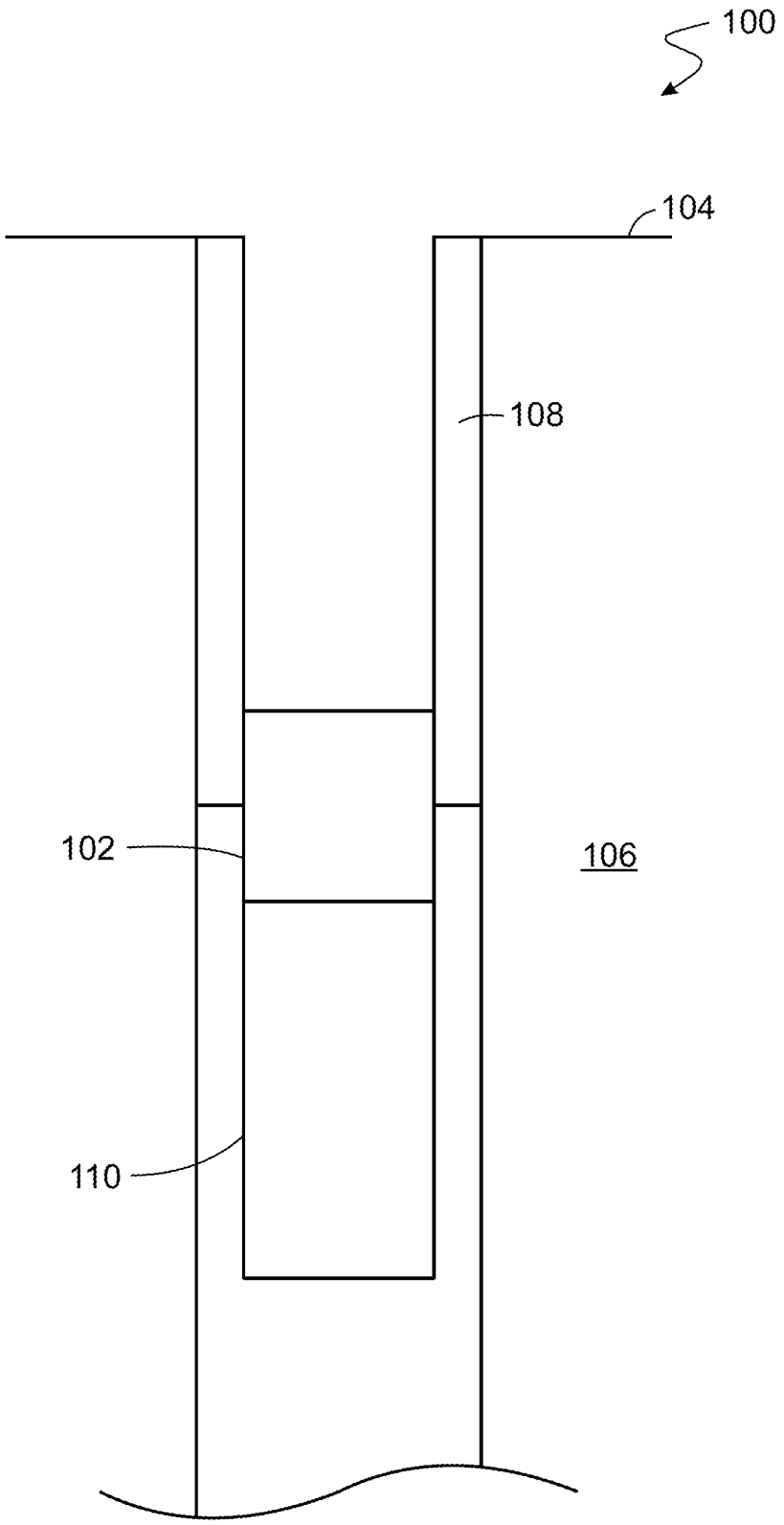
FIG. 1 is a schematic diagram of an example of a well in which an implementation of a well tool assembly is installed.

FIG. 1 is a schematic diagram of an example of a well 100 in which an implementation of a well tool assembly 102 is installed. The well 100 is formed from a surface 104 through a subterranean zone 106 (e.g., a formation, a portion of a formation, multiple formations) to a subsurface reservoir (not shown) in which hydrocarbons are trapped. A casing string (or casing) 108 is run into and set (e.g., cemented) within the well 100. In some implementations, only one casing string 108 can be used. In some implementations, multiple casing strings, each of successively smaller diameters, can be run into the well 100.

The well tool assembly 102 is used to hang a liner 110 from the downhole end of the casing string 108. For example, the liner 110 can be a casing string that runs downhole of the casing string 108. Alternatively, the liner 110 can be a production tubing that runs from the downhole end of the casing string 108 to the subsurface reservoir and into which hydrocarbons from the subsurface reservoir flow. In general, the liner 110 can be any tubular that can be used in a well operation.

As described below with reference to the following figures, the well tool assembly 102 can be run into and set in the well 100 at a downhole location in the well 100. The well tool assembly 100 can provide structural support during well construction as well as over the life of the well 100. In addition, and either during well construction or during well operation (e.g., hydrocarbon production) or both, the well tool assembly 102 isolates downhole fluids and downhole pressure from coming up the well 100 during the well life time. In addition, the well tool assembly 102 can periodically measure well properties (e.g., pressure, temperature, other well properties) both uphole and downhole of the downhole location at which the well tool assembly 102 is installed. The well tool assembly 102 can communicate the measured well properties to the surface 104 (e.g., to control equipment at the surface 104).

Figure 2:
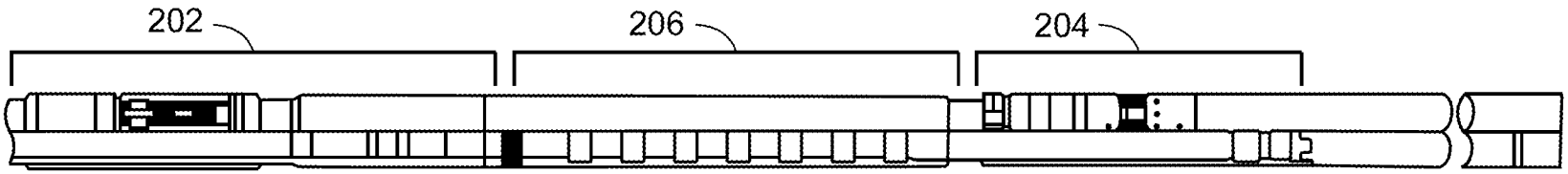
FIG. 2 is a schematic diagram of components of the well tool assembly of FIG. 1.

FIG. 2 is a schematic diagram of components of the well tool assembly 102 (FIG. 1). The assembly 102 includes a liner hanger 202 and a liner packer 204 coupled to the liner hanger 202. The liner hanger 202 can support a liner (e.g., the liner 110) within the well 100 (FIG. 1). The liner hanger 202 can also be supported by a tubular (e.g., the casing 108 within the well 100. The liner hanger 202 provides structural support to the well 100 during well construction and during well operation over the life of the well 100. The liner hanger 202 attaches to an inner surface of a string previously installed within the well 100, e.g., the inner wall of the casing 108. For example, the liner hanger 202 can be hung, i.e., connected to the casing 108, by setting slips that grip against the inner wall of the casing 108. In another example, the liner hanger 202 can be an expandable hanger hung by external expansion of the liner hanger 202 against the inner wall of the casing 108.

In some implementations, the assembly 102 includes a liner tieback receptacle 206 connected to the liner hanger 202 and positioned between the liner hanger 202 and the liner packer 204. The liner tieback receptacle 206 enables the base of a tubular (e.g., production tubing) to be stabbed into the liner top, providing both a seal and a continuous conduit for produced fluids. For example, the liner tieback receptacle 206 can receive the end of the liner 110 and form the fluidically sealed conduit from the liner 110 through the liner hanger 202.

Figure 3:
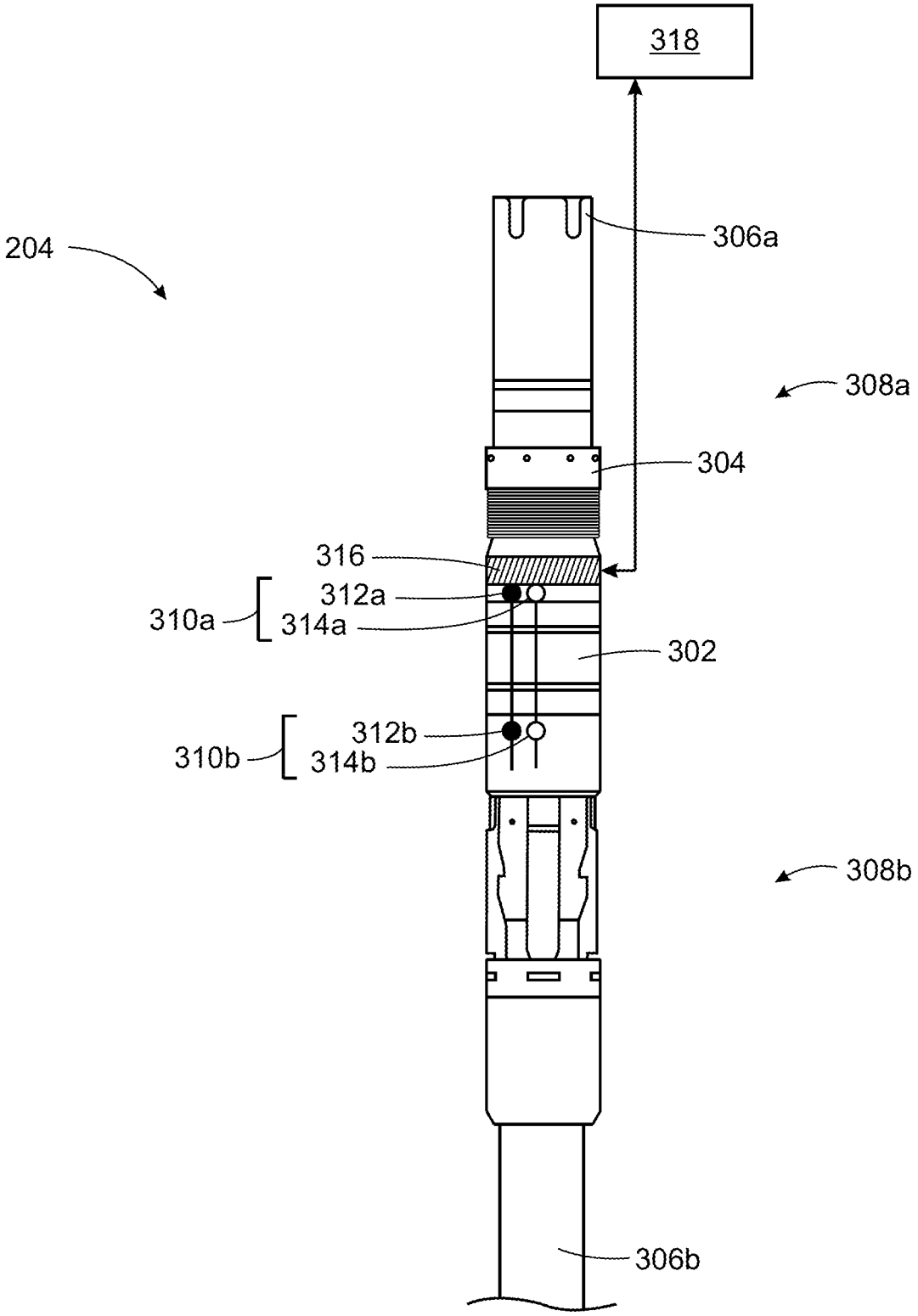
FIG. 3 is a schematic diagram of an example of a liner packer of the well tool assembly of FIG. 1.

The liner packer 204 can fluidically seal an outer surface of the liner hanger 202 to an inner surface of the tubular (e.g., the casing 108). FIG. 3 is a schematic diagram of an example of the liner packer 204 of the well tool assembly 102 (FIG. 1). The liner packer 204 includes a seal element 302 on an outer surface 304 of the liner packer 204. The seal element 302 can fluidically seal the outer surface 304 of the liner packer 304 to the inner surface of the tubular (e.g., the casing 108). For example, the seal element 302 can be an expandable seal or a static seal such as a metal-to-metal seal. The seal element 302 is positioned between the ends (a first end 306*a* and a second, opposite end 306*b*) on the outer surface 304 of the liner packer 204. The position of the seal element 302 on the outer surface 304 separates the well 100 into a first portion 308*a* between the first end 306*a* and the seal element 302, and a second portion 308*b* between the seal element 302 and the second end 306*b*. When the well tool assembly 102 is run into and installed in the well 100, the first portion 308*a* can reside uphole of the seal element 302 (the uphole portion), and the second portion 308*b* can reside downhole of the seal element 302 (the downhole portion). As explained above, the liner packer 204 fluidically isolates the first portion 308*a* (e.g., the uphole portion) from the second portion 308*b* (e.g., the downhole portion).

The liner packer 204 includes a first sensor sub-assembly 310*a* attached to the outer surface 304 of the liner packer 204 on the first portion 308*a* of the liner packer 204. The first sensor sub-assembly 310*a* can sense well properties in a first space between the outer surface 304 of the liner packer 204 and the inner surface of the tubular (e.g., the inner wall of the casing 108), specifically in the first portion 308*a* of the well 100. The liner packer 204 includes a second sub-assembly 310*b* attached to the outer surface 304 of the liner packer 204 on the second portion 308*b* of the liner packer 204. The second sensor sub-assembly 310*b* can sense well properties in a second space between the outer surface 304 of the liner packer 204 and the inner surface of the tubular (e.g., the inner wall of the casing 108), specifically in the second portion 308*b* of the well 100.

In some implementations, the first sensor sub-assembly 310*a* includes a temperature sensor 312*a* and a pressure sensor 314*a* that can sense temperature and pressure, respectively, adjacent the respective sensors in the first portion 308*a* (e.g., the uphole portion). The second sensor sub-assembly 310*b* includes a temperature sensor 312*b* and a pressure sensor 314*b* that can sense temperature and pressure, respectively, adjacent the respective sensors in the second portion 308*b* (e.g., the downhole portion). The sensor sub-assemblies can include additional or different sensors to measure well properties such as gas chromatography sensors that measure levels of different gases such as carbon (C1, C2, C3, C4, C5), hydrogen sulfide content, carbon dioxide or other gases. In this manner, the sensors in the sub-assemblies can sense well properties uphole and downhole of the well tool assembly 102 after the assembly 102 has been deployed to hang the liner 110 (FIG. 1) downhole of the casing 108 (FIG. 1).

In some implementations, the well tool assembly 102 can be deployed as a smart component that can take action responsive to changes in the well properties on either side of the seal element 302. To do so, the well tool assembly 102 includes a controller 316 operatively coupled to the first sensor sub-assembly 310*a* and the second sensor sub-assembly 310*b*. In some implementations, the controller 316 can be deployed as a computer system that includes one or more processors and a computer-readable medium (e.g., non-transitory computer-readable medium) storing instructions executable by the one or more processors to perform operations. The controller 316 can receive sensed well properties from the first sensor sub-assembly 310*a* and the second sensor sub-assembly 310*b*, and transmit the received sensed well properties to a receiver, e.g., a receiver deployed at the surface 104 (FIG. 1) of the well 100.

In some implementations, the controller 316 is mounted to the liner packer 204, e.g., on the outer surface 304 of the liner packer 204. For example, the controller 316 can be threaded to the top of the liner packer 204. The controller 316 can include a power source (e.g., a battery) to power the controller 316. Alternatively, or in addition, power to the controller 316 can be provided by an electric cable run into the well 100 from the surface 104.

As shown in FIG. 3, the controller 316 is installed on the first portion 308*a* (i.e., the uphole portion) of the liner packer 204. Such installation can allow easier access to the controller 316 (e.g., for removal, repair) compared to installation on the second portion 308*b* (i.e., the downhole portion).

To receive the well properties from the sensor sub-assemblies, the controller 106 can be connected to the sensor sub-assemblies through wired connections, e.g., in series on in parallel. The wired connection that connects the controller 316 on the first portion 308*a* with the second sensor sub-assembly 310*b* on the second portion 308*b* can pass through or over the seal element 302. Such a connection allows the second sensor sub-assembly 310*b* to transmit sensed well properties in the second portion 308*b* across the seal element 302 to the controller 316 in the first portion 308*a*. Alternatively or in addition, each sensor sub-assembly can include a transmitter that can wirelessly transmit the sensed well properties to a receiver included in the controller 316.

In some implementations, the controller 316 can include and/or operate as a transmitter that can transmit the well properties to a receiver 318 installed uphole of the controller 316, e.g., at a surface 102 (FIG. 1). The controller 316 and the receiver 318 can exchange signals, e.g., wirelessly or through wired connections. In some implementations, the receiver 318 can be a component of a controller similar to the controller 316.

As described above, the controller 316 can receive sensed well properties from well locations uphole and downhole of the seal element 302. For example, the sensor sub-assemblies can be deployed in a tubing-casing annulus (TCA) defined by an outer surface of the liner 110 (FIG. 1) and an inner surface of the casing 108 (FIG. 1), but on either side of the seal element 302. Each sensor sub-assembly can periodically (e.g., at a frequency of one or more times per second, one or more times per minute, one or more times per hour, in real-time) transmit sensed well properties to the controller 316. In turn, the controller 316 can periodically transmit the received well properties to the receiver 318 at the surface 102 (FIG. 1). Either during well construction or during well operation (or both), if the seal element 302 of the liner packer 204 maintains the fluidic isolation between the downhole portion and the uphole portion, the sensor sub-assemblies will not sense any appreciable change in the sensed well properties. However, if the fluidic isolation is not maintained, then the sensor sub-assemblies will sense a change in the sensed well properties. The controller 316 will receive the changed well properties and transmit the same to the receiver 318 at the surface 104. An operator at the surface 104, who receives the changed well properties, can implement corrective action. For example, a change in sensed pressure can indicate a leak that can necessitate well workover or other remedial operations or possibly well shutdown. In this manner, the well tool assembly 102 operates as a smart controller to monitor well properties and to allow a well operator to take corrective action in response to the well tool assembly 102 sensing a deviation in well properties from expected behavior.

Figure 4:
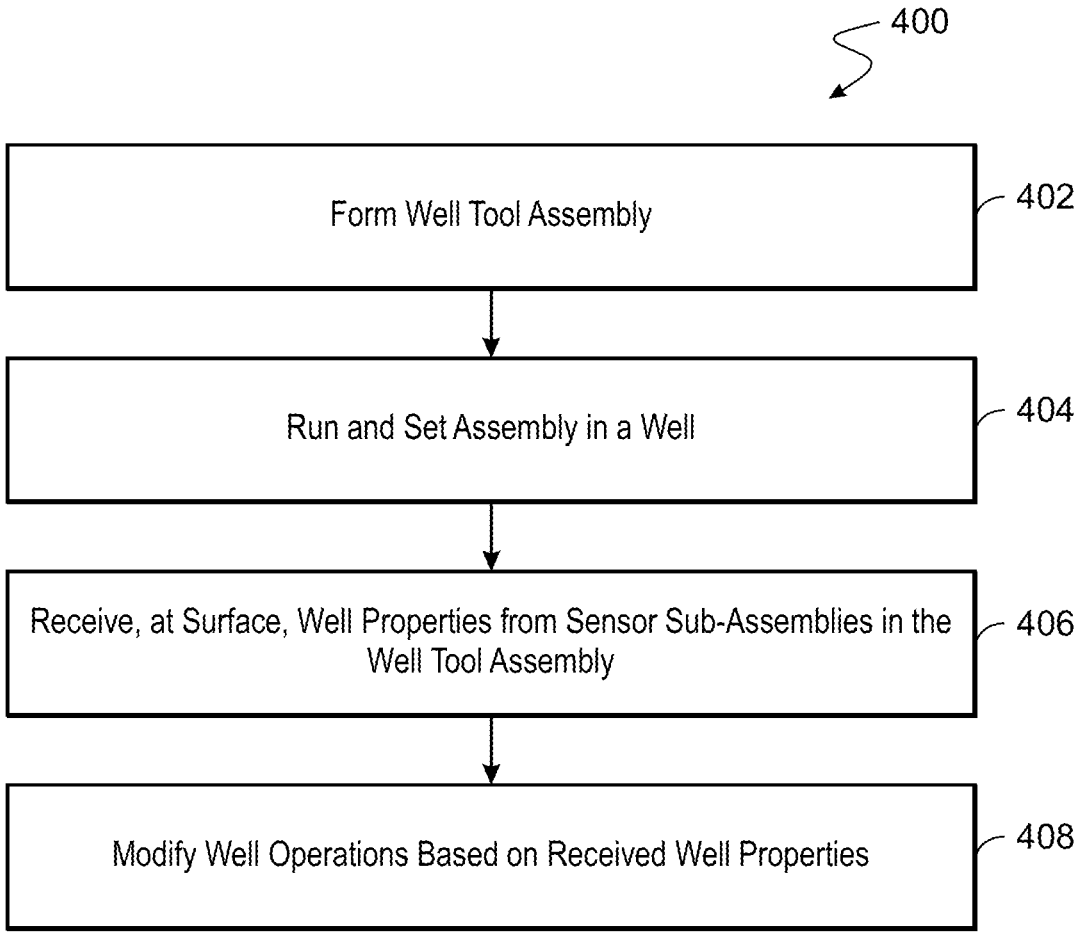
FIG. 4 is a flowchart of an example of a method of implementing the well tool assembly of FIG. 1.

FIG. 4 is a flowchart of an example of a method 400 of implementing the well tool assembly of FIG. 1. Some portions of the method 400 can be implemented by a well operator. Some portions of the method 400 can be implemented by a controller, e.g., the controller 316 (FIG. 3). At 402, a well tool assembly is formed. To do so, the seal element 302 (FIG. 3) is attached to the outer surface 304 (FIG. 3) of the liner packer 204 (FIG. 3). The seal element 302 can fluidically seal the outer surface of the liner packer to an inner surface of the tubular (e.g., the casing 108 (FIG. 1)) in which the liner packer is configured to be installed. The first sensor sub-assembly 310*a* is attached to the outer surface 304 of the liner packer on the first portion 308*a* of the liner packer between the seal element and the first end 306*a* of the liner packer. The second sensor sub-assembly 310*b* is attached to the outer surface 304 of the liner packer on the second portion 308*b* of the liner packer between the seal element and the second end 306*b* of the liner packer. The controller 316 is attached on the outer surface of the liner packer on the first portion. The liner hanger 202 (FIG. 2) is coupled to the liner packer 204.

At 404, the well tool assembly is run into the well 100 (FIG. 1) and set at a downhole location in the well 100. At 406, well properties sensed by the first sensor and the second sensor are periodically received at a surface of the well. The well properties are received from the controller 316 at the receiver 318. In some implementations, based on the well properties received at the surface, a change in the well properties is sensed by the second sensor sub-assembly or the first sensor sub-assembly. In response, corrective well operations can be performed.

Implementations of the subject matter described here can diagnose and verify a correct seal across the liner packer. The well tool assembly described here can detect pressures above and below the liner packer. Diagnostic operations across the liner packer can be performed using the well properties sensed by the sensor sub-assemblies. Implementing the techniques described here can negate or reduce the need for complex rig intervention jobs. The sensor sub-assemblies can be deployed as permanent well installations to monitor variations between active formation environment and isolated well completion, which would allow well operators to determine possible communications across the packer elements during the well's lifetime.

Thus, particular implementations of the subject matter have been described. Other implementations are within the scope of the following claims.

The invention claimed is:

1. A well tool assembly comprising:

a liner hanger configured to support a liner within a well, the liner hanger configured to be supported by a tubular installed within the well; and a liner packer coupled to the liner hanger, the liner packer configured to fluidically seal an outer surface of the liner hanger to an inner surface of the tubular, the liner packer comprising:

a seal element on an outer surface of the liner packer, the seal element configured to fluidically seal the outer surface of the liner packer to the inner surface of the tubular, a first sensor sub-assembly attached to the outer surface of the liner packer on a first portion of the liner packer between the seal element and a first end of the liner packer, the first sensor sub-assembly configured to sense well properties in a first space between the outer surface of the liner packer and the inner surface of the tubular, a second sensor sub-assembly attached to the outer surface of the liner packer on a second portion of the liner packer between the seal element and a second end of the liner packer, the second end opposite the first end, the second sensor sub-assembly configured to sense well properties in a second space between the outer surface of the liner packer and the inner surface of the tubular, and a controller operatively coupled to the first sensor sub-assembly and the second sensor sub-assembly, the controller comprising one or more processors and a computer-readable medium storing instructions executable by the one or more processors to perform operations comprising:

receiving sensed well properties from the first sensor sub-assembly and the second sensor sub-assembly, and transmitting the received sensed well properties to a receiver.

2. The assembly of claim 1, wherein, when the assembly is installed within the well, the first portion is uphole of the liner packer, and the second portion is downhole of the liner packer.

3. The assembly of claim 2, wherein the seal element is configured to fluidically isolate the first portion from the second portion.

4. The assembly of claim 2, wherein each of the first sensor sub-assembly and the second sensor sub-assembly, respectively, comprises:

a pressure sensor configured to sense a pressure in the first portion and the second portion, respectively; and a temperature sensor configured to sense a temperature in the first portion and the second portion, respectively.

5. The assembly of claim 2, wherein the controller is attached to the first portion of the liner packer.

6. The assembly of claim 5, wherein the second sensor sub-assembly is configured to transmit the sensed well properties to the controller across the seal element.

7. The assembly of claim 1, further comprising the receiver configured to wirelessly receive the sensed well properties from the controller.

8. The assembly of claim 1, further comprising a liner tieback receptacle positioned between the liner hanger and the liner packer, the liner tieback receptacle configured to receive an end of the liner and to form a fluidically sealed conduit from the liner through the liner hanger.

9. A method comprising:

forming a well tool assembly by:

attaching a seal element to an outer surface of a liner packer, the seal element configured to fluidically seal the outer surface of the liner packer to an inner surface of a tubular in which the liner packer is configured to be installed, attaching a first sensor sub-assembly to the outer surface of the liner packer on a first portion of the liner packer between the seal element and a first end of the liner packer, attaching a second sensor sub-assembly to the outer surface of the liner packer on a second portion of the liner packer between the seal element and a second end of the liner packer, the second end opposite the first end, attaching a controller on the outer surface of the liner packer on the first portion, the controller configured to receive sensed well properties from the first sensor sub-assembly and the second sensor sub-assembly, and coupling a liner hanger to the liner packer, the liner hanger configured to support a liner within the well, the liner hanger supported by the tubular;

running the well tool assembly into and setting the well tool assembly at a downhole location in a well; and periodically receiving, at a surface of the well and from the controller, the well properties sensed by the first sensor sub-assembly and the second sensor sub-assembly.

10. The method of claim 9, wherein, after running the well tool assembly into and setting the well tool assembly at the downhole location in the well, the first portion is uphole of the liner packer, and the second portion is downhole of the liner packer, wherein the method comprises fluidically isolating the first portion from the second portion.

11. The method of claim 9, wherein each of the first sensor sub-assembly and the second sensor sub-assembly, respectively, comprises:

a pressure sensor configured to sense a pressure in the first portion and the second portion, respectively, and a temperature sensor configured to sense a temperature in the first portion and the second portion, respectively, wherein the method further comprises:

sensing, by each pressure sensor, the pressure in the first portion and the second portion, respectively; and sensing, by each temperature sensor, the temperature in the first portion and the second portion, respectively.

12. The method of claim 9, further comprising:

determining, based on the well properties received at the surface, a change in the well properties sensed by the second sensor sub-assembly; and in response to the determining, performing corrective well operations.

13. The method of claim 12, wherein the change in the well properties comprises a change in the pressure sensed by a pressure sensor, wherein the pressure sensor is installed in an annulus between the outer surface of the liner packer and the inner surface of the tubular.

14. The method of claim 12, wherein the change in the well properties comprises a change in the temperature sensed by a temperature sensor, wherein the temperature sensor is installed in an annulus between the outer surface of the liner packer and the inner surface of the tubular.

15. The method of claim 12, wherein the corrective well operations comprise ceasing well operations until the corrective well operations have been completed.

* * * * *